US009926765B2

(12) United States Patent
Goodman et al.

(10) Patent No.: US 9,926,765 B2
(45) Date of Patent: Mar. 27, 2018

(54) SLIP CONFIGURATION FOR DOWNHOLE TOOL

(71) Applicant: Weatherford Technology Holdings, LLC, Houston, TX (US)

(72) Inventors: Brandon C. Goodman, Kingwood, TX (US); Michael J. Sessa, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 299 days.

(21) Appl. No.: 14/631,424

(22) Filed: Feb. 25, 2015

(65) Prior Publication Data

US 2016/0245039 A1 Aug. 25, 2016

(51) Int. Cl.
*E21B 33/128* (2006.01)
*E21B 33/129* (2006.01)

(52) U.S. Cl.
CPC ..... *E21B 33/129* (2013.01); *E21B 33/128* (2013.01)

(58) Field of Classification Search
CPC ..... E21B 33/128; E21B 33/129; E21B 33/12–33/12955; E21B 33/13–33/16
USPC ..... 166/179–203
See application file for complete search history.

(56) References Cited

U.S. PATENT DOCUMENTS 1,436,274 A 11/1922 Mack
1,684,266 A 9/1928 Fisher et al.
1,809,080 A 6/1931 Sweet et al.
1,949,498 A 3/1934 Stone et al.
2,189,697 A * 2/1940 Baker ..... E21B 33/134 166/114
3,667,543 A 6/1972 Dean
4,151,875 A 5/1979 Sullaway
4,185,689 A 1/1980 Harris
4,708,202 A 11/1987 Sukup et al.
5,224,540 A 7/1993 Streich et al.
5,271,468 A 12/1993 Streich et al.
5,390,737 A 2/1995 Jacobi et al.
6,167,963 B1 1/2001 McMahan et al.
6,712,153 B2 3/2004 Turley et al.
(Continued)

FOREIGN PATENT DOCUMENTS

EP 0 454 466 A 10/1991
GB 2427220 A 12/2006

OTHER PUBLICATIONS

Office Action filed in co-pending Canadian Application No. 2,866,387, dated Aug. 9, 2016, 3 Pages.
(Continued)

*Primary Examiner* — George S Gray
(74) *Attorney, Agent, or Firm* — Blank Rome LLP

(57) ABSTRACT

A downhole tool or plug is used for sealing in tubing. A mandrel of the tool has a first shoulder disposed toward a downhole end of the mandrel. A sealing element for sealing in the tubing is disposed on the mandrel adjacent the first shoulder, a slip is disposed on the mandrel adjacent the sealing element, and a cone is disposed on the mandrel adjacent the slip. In setting the tool, the cone moves toward the first shoulder, wedges the slip against the tubing, and compresses the sealing element between the slip and the first shoulder. Force applied against a seated plug in the mandrel transfers through the mandrel to the cone and slip without passing through the sealing element.

10 Claims, 5 Drawing Sheets

(56) References Cited

U.S. PATENT DOCUMENTS

| | | | |
|---|---|---|---|
| 6,769,491 | B2 | 8/2004 | Zimmerman et al. |
| 7,036,602 | B2 | 5/2006 | Turley et al. |
| 7,124,831 | B2 | 10/2006 | Turley et al. |
| 7,389,823 | B2 | 6/2008 | Turley et al. |
| 2003/0000710 | A1 | 1/2003 | Turley et al. |
| 2003/0188860 | A1 | 10/2003 | Zimmerman et al. |
| 2003/0226668 | A1 | 12/2003 | Zimmerman et al. |
| 2004/0177952 | A1 | 9/2004 | Turley et al. |
| 2005/0121201 | A1 | 6/2005 | Turley et al. |
| 2005/0189104 | A1 | 9/2005 | Turley et al. |
| 2006/0124307 | A1 | 6/2006 | Turley et al. |
| 2006/0131031 | A1 | 6/2006 | McKeachnie et al. |
| 2006/0278405 | A1 | 12/2006 | Turley et al. |
| 2007/0039160 | A1 | 2/2007 | Turley et al. |
| 2007/0074873 | A1 | 4/2007 | McKeachnie et al. |
| 2008/0128133 | A1 | 6/2008 | Turley et al. |
| 2011/0048740 | A1 | 3/2011 | Ward et al. |
| 2011/0088891 | A1 * | 4/2011 | Stout ..... E21B 33/1204 166/120 |

OTHER PUBLICATIONS

World Oil, "Baker introduces two packers as corrosion-proof as fiberglass tubing—because they are fiberglass!", Baker Fiberglass Packers, Baker Oil Tools, Jun. 1968, 3-pgs.

Baker Hughes, "SHADOW Series Frac Plug," Brochure, copyright 2014, revision Mar. 2014.

Carpenter, C., "Fracture Plug," Journal of Petroleum Technology, Mar. 2014.

* cited by examiner

SLIP CONFIGURATION FOR DOWNHOLE TOOL

BACKGROUND

In connection with the completion of oil and gas wells, it is frequently necessary to utilize packers, plugs, liner hangers, and the like in both open and cased boreholes for a number of reasons. For example, when fracturing a hydrocarbon bearing formation, a section of the well may be isolated from other sections of the well so fluid pressure can be applied to the isolated section while protecting the remainder of the well from the applied pressure.

In a staged fracturing operation, for example, multiple zones of a formation need to be isolated sequentially for treatment. To achieve this, operators install a fracture assembly as shown in FIG. 1A in a wellbore 10, which may have casing 12 and perforations 14. Typically, the assembly has a top liner packer (not shown) supporting a tubing string 16 in the wellbore 10. Packers 50 on the tubing string 16 isolate the wellbore 10 into zones 18A-C, and various sliding sleeves 20 on the tubing string 16 can selectively communicate the tubing string 16 with the various zones 18A-C.

The packers 50 typically have a first diameter to allow the packer 50 to be run into the wellbore 12 and have a second radially larger size to seal in the wellbore 12. The packer 50 typically consists of a mandrel 52 about which a sealing element 58, slips 54, cones 56, and the like are assembled.

Other downhole tools are also used for isolating a wellbore and have a mandrel about which a sealing element, slips, cones, and the like are assembled. For example, a plug 50 as shown in FIG. 1B can be placed within a wellbore 10 to isolate upper and lower sections of production zones. The plug 50 includes a sealing element 58, slips 54, and cones 56 on a mandrel 52. When set, the plug 50 creates a pressure seal in the casing 12 of the wellbore 10, which allows pressurized fluids to treat an isolated zone of the formation, such as through perforations 14 in the casing 12.

On packers, plugs, and other downhole tools, the sealing elements 58 are typically composed of an elastomeric material, such as rubber. When the sealing element 58 is compressed in one direction it expands in another. Therefore, as the sealing element 58 is compressed longitudinally, it expands radially to form a seal with the well or casing wall.

The slips 54 used on the downhole tool 50 prevent movement of the sealing element 58 and the production string 16 or tool 50 during hydraulic stimulation. Two slips 54 are often employed in situations where the downhole tool 50 may need to hold pressure from above and below the sealing element 58. In uni-directional pressure applications, such as fracturing, two slips 58 are still used to prevent excessive build-up of rubber pressure leading to a collapse of the tool's mandrel 52.

For example, FIG. 2A illustrates a traditional slip configuration 60 according to the prior art for a downhole tool 50 (e.g., a packer, plug, etc.). A mandrel 52 of the downhole tool 50 has a lower sub or shoulder element 62*b* affixed at one end. The opposite end has a support or push ring 62*a* acting as an opposite shoulder element. Between these shoulder elements 62*a-b*, the mandrel 52 has a sealing element 68 surrounded by opposing cones 66*a-b*. Finally, a pair of opposing slips 64*a-b* are disposed outside the cones 66*a-b*.

During run-in of the tool 50 through tubing 15 (e.g., casing, or the like), the shoulder elements 62*a-b* are spaced apart, the slips 64*a-b* lay retracted against the mandrel 52, and the sealing element 68 is uncompressed. When the tool

50 reaches a desired depth in the tubing 15, the tool 50 can be set as shown in FIG. 2B. To set the tool 50, the shoulder elements 62*a-b* are moved toward one another, either by holding the support 62*a* while pulling the sub 62*b* with the mandrel 52, by holding the mandrel 52 with its sub 62*b* while pushing on the support 62*a*, or by performing a combination of these actions.

When deployed downhole, for example, the tool 50 can activated by a setting tool 70. During setting, the slips 64*a-b* ride up the cones 66*a-b* and set against the tubing 15. In the meantime, the cones 66*a-b* move along the mandrel 52 toward one another and compress the sealing element 68. Finally, the compressed sealing element 68 expands outward against the tubing 15 to create a seal in the annulus between the mandrel 52 and the tubing 15. In general, the upper slip 64*a* is used to hold against slippage from downhole pressure, while the lower slip 64*b* is used to hold against slippage from uphole pressure.

During operations, operators may close off the through-bore 54 of the tool's mandrel 52 so that pressure can be applied uphole of the tool 50. Communication past the tool 50 between the mandrel 52 and tubing 15 is prevented by the sealing element 58. As shown in FIG. 2C, a ball B deployed to the tool 50 engages a seat 56 in the mandrel's through-bore 54. With the ball B seated, the tool 50 isolates upper and lower portions of the tubing 15 so that fracture and other operations can be completed uphole of the tool 50, while pressure is kept from downhole locations.

As shown in FIG. 2C, pressure applied against the seated ball B tends to push against the mandrel 52. The anchored slips 64*a-b*, cones 66*a-b*, and sealing element 68 can remain engaged with the tubing 15, but may be allowed to slide along the mandrel 52. For example, the mandrel 52 may be pushed further through the anchored slips 64*a-b*, cones 66*a-b*, and sealing element 68 at least until the mandrel 52 shoulders out against the support 62*a*.

The pressure (force) applied against the seated ball B passes to the mandrel 52 through the seat 56 and then passes through the anchored upper slip 64*a* and cone 66*a*. At this point, a portion of the boost load is directed into the tubing 15. The boost load then passes through the set sealing element 68, and then through the lower cone 66*b* and slip 64*b*. Eventually, the remaining pressure (force) extends to the tubing 15 from the lower slip 64*b*.

The force acting through the anchored components 60 forces the sealing element 68 further against the mandrel 52. At some point, the mandrel 52 can collapse due to the boost force applied about the mandrel's circumference. This form of mandrel collapse due to a sealing element's pressure on a tool 50, such as packers and plugs with slips, has traditionally been addressed by using an expansion joint, using a dual slip system as shown in FIGS. 2A-2C, or using a bi-directional slip.

Various types of downhole tools, such as packers and plugs, having slip configurations are known in the art. For example, Weatherford's Ultrapak and Optipak packers use either opposing uni-directional slips or use a bi-directional slip. Weatherford's composite fracture plugs use two opposing uni-directional slips and have a smaller through-bore so the mandrel can withstand high pressures. Other downhole tools include the removable bridge plug or packer disclosed in U.S. Pat. No. 6,167,963 and the Shadow Series Frac Plug available from Baker Hughes Incorporated.

The subject matter of the present disclosure is directed to overcoming, or at least reducing the effects of, one or more of the problems set forth above.

SUMMARY

In a first embodiment, a downhole tool for sealing in tubing comprises a mandrel having first and second ends. A first shoulder is disposed toward the first end of the mandrel, and a sealing element for sealing in the tubing is disposed on the mandrel adjacent the first shoulder toward the second end. A slip is disposed on the mandrel adjacent the sealing element toward the second end, and a cone is disposed on the mandrel adjacent the slip toward the second end. The cone moves toward the first shoulder, wedges the slip against the tubing, and compresses the sealing element between the slip and the first shoulder.

In a second embodiment, a downhole plug for sealing in tubing has a mandrel defining a through-bore from an uphole end to a downhole end. A first shoulder is disposed toward the downhole end of the mandrel, and a sealing element for sealing in the tubing is disposed on the mandrel adjacent the first shoulder toward the uphole end. A slip is disposed on the mandrel adjacent the sealing element toward the uphole end, and a cone is disposed on the mandrel adjacent the slip toward the uphole end. In a set condition, the cone and the first shoulder are moved toward one another, the slip is wedged against the tubing, and the sealing element is compressed between the slip and the first shoulder.

In general, the wedged slip above the sealing element tends to prevent downhole movement of the tool while in use. Accordingly, the slip can have teeth or other features in a downhole direction to bite into the tubing.

In either embodiment, the sealing element can have a second shoulder disposed on the mandrel between the slip and the sealing element. The slip moves the second shoulder toward the first shoulder when compressing the sealing element. The cone can have a ratchet mechanism engaging the mandrel. The ratchet mechanism allows the cone to move in a first direction toward the first shoulder and prevents the cone from moving in a second direction away from the first shoulder.

The through-bore can have a seat engageable by a plugging element at least partially closing off fluid communication through the through-bore. When set and plugged, the tool or plug provides a plugged upper annulus for stimulation. Utilizing one slip above the sealing element decreases the pressure seen by the sealing element and enables the mandrel to have a thinner-wall (i.e., gives the mandrel a bigger inner dimension of the through-bore). It also puts the slip closer to the top of the tool or plug and therefore makes the tool or plug easier to mill in situations where the tool or plug has to be milled.

The tool or plug can also include a setting mechanism operable to move at least one of the cone and the mandrel relative the other. This setting mechanism can be separate from the mandrel, or can be part of the tool or plug.

In a third embodiment, a method of sealing a downhole tool in tubing involves deploying a mandrel of the downhole tool in the tubing, and moving at least one of a cone and a first shoulder on the mandrel relative the other. The method involves wedging a slip disposed on the mandrel adjacent the cone against the tubing, and compressing a sealing element disposed on the mandrel between the slip and the first shoulder against the tubing.

To move the at least one the cone and the first shoulder on the mandrel relative to the other, the method can involve pulling on the mandrel while pushing against the cone and/or ratcheting the cone along the mandrel and preventing movement of the cone in an opposite direction. The method can further involve seating a plug in a through-bore of the mandrel; and applying fluid pressure against the seated plug.

The foregoing summary is not intended to summarize each potential embodiment or every aspect of the present disclosure.

BRIEF DESCRIPTION OF THE DRAWINGS

FIG. 2A illustrates a traditional slip configuration according to the prior art on a downhole tool during run-in.

FIG. 4A illustrates the slip configuration on the downhole tool during run-in.

DETAILED DESCRIPTION

Figure 1A:
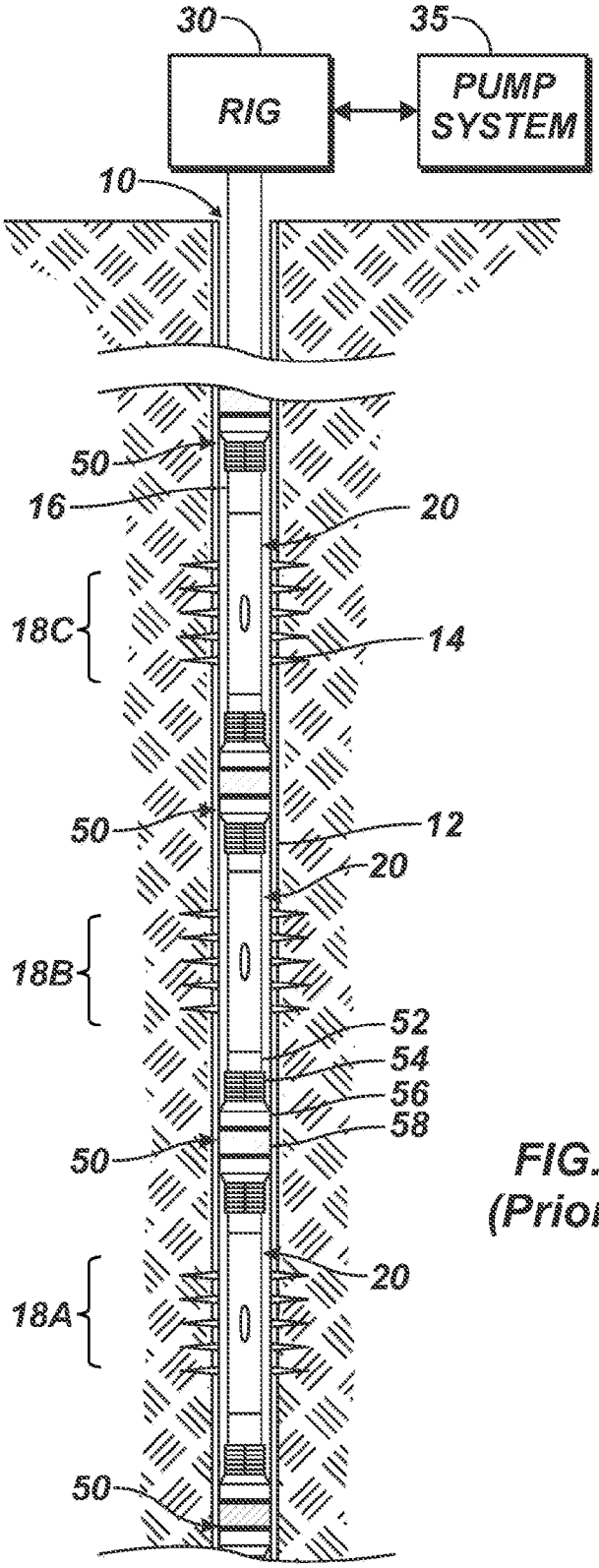
FIG. 1A (Prior Art)
FIG. 1A illustrates a tubing string having multiple sleeves and packers of a fracture system.
Figure 1B:
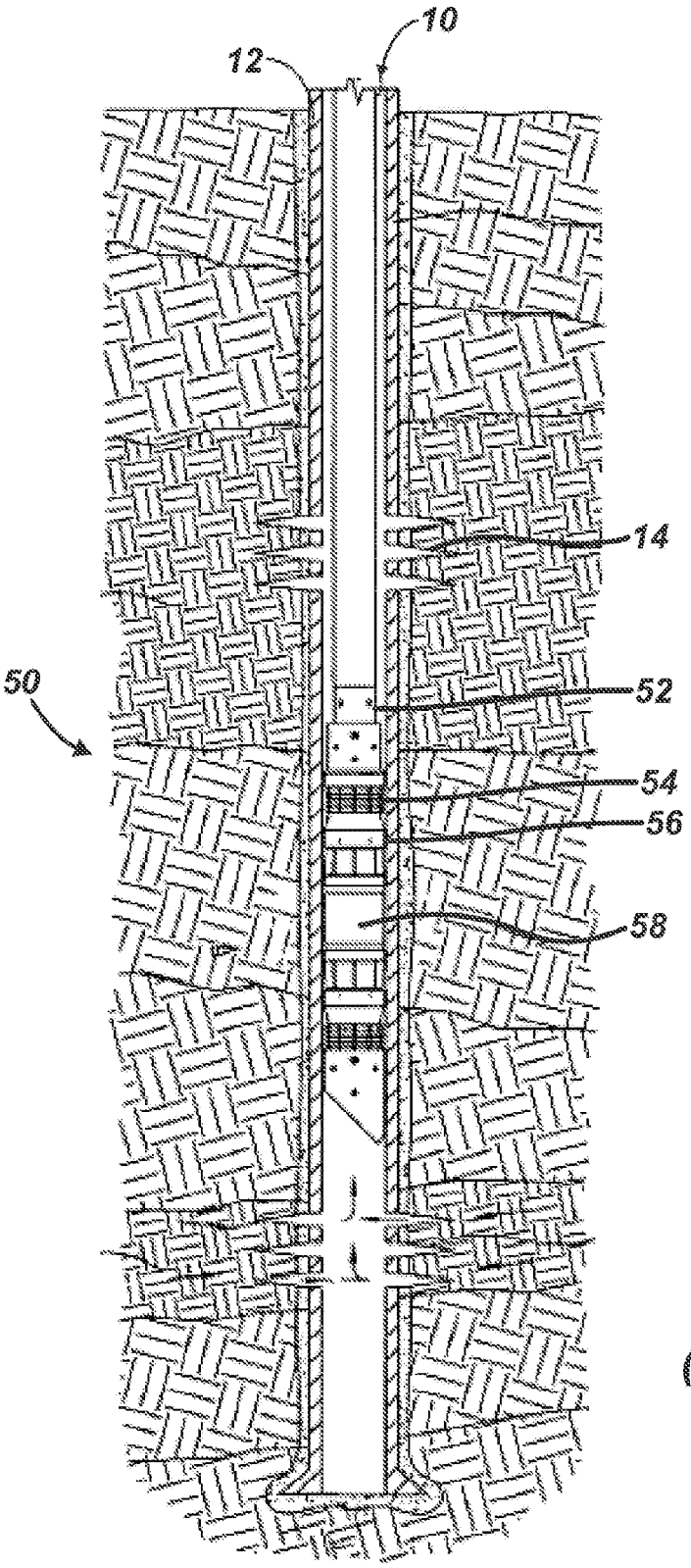
FIG. 1B (Prior Art)
FIG. 1B illustrates a plug installed in casing and isolating perforated zones of a formation.
Figure 2A:
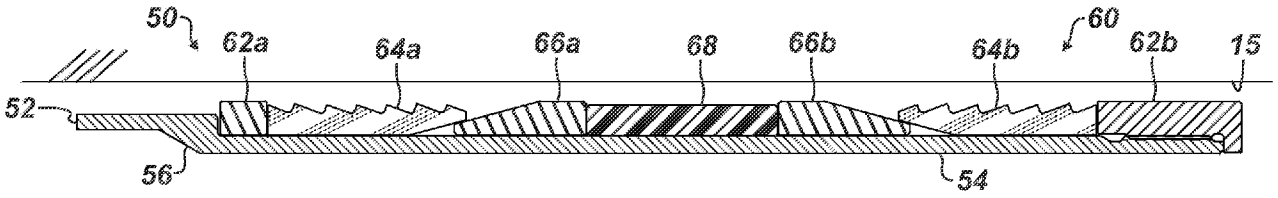
FIG. 2A (Prior Art)
Figure 2B:
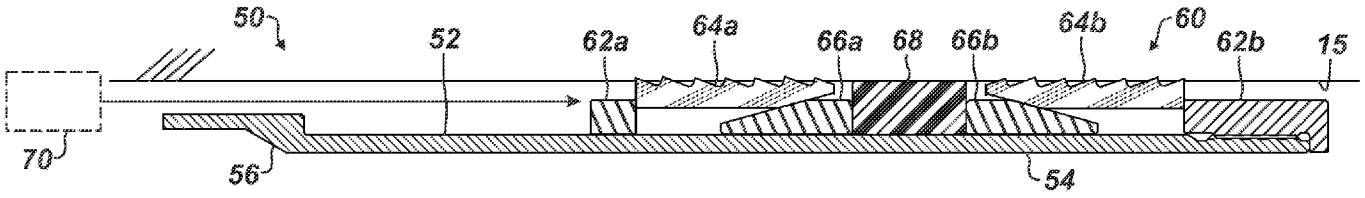
FIG. 2B (Prior Art)
FIG. 2B illustrate the traditional slip configuration during setting.
Figure 2C:
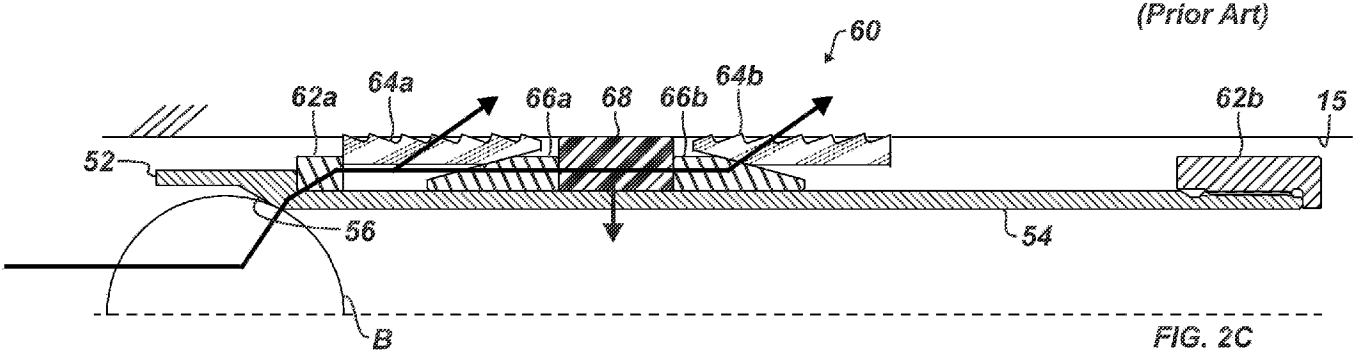
FIG. 2C (Prior Art)
FIG. 2C illustrate the traditional slip configuration after the mandrel has been plugged and pressure has been applied.
Figure 3:
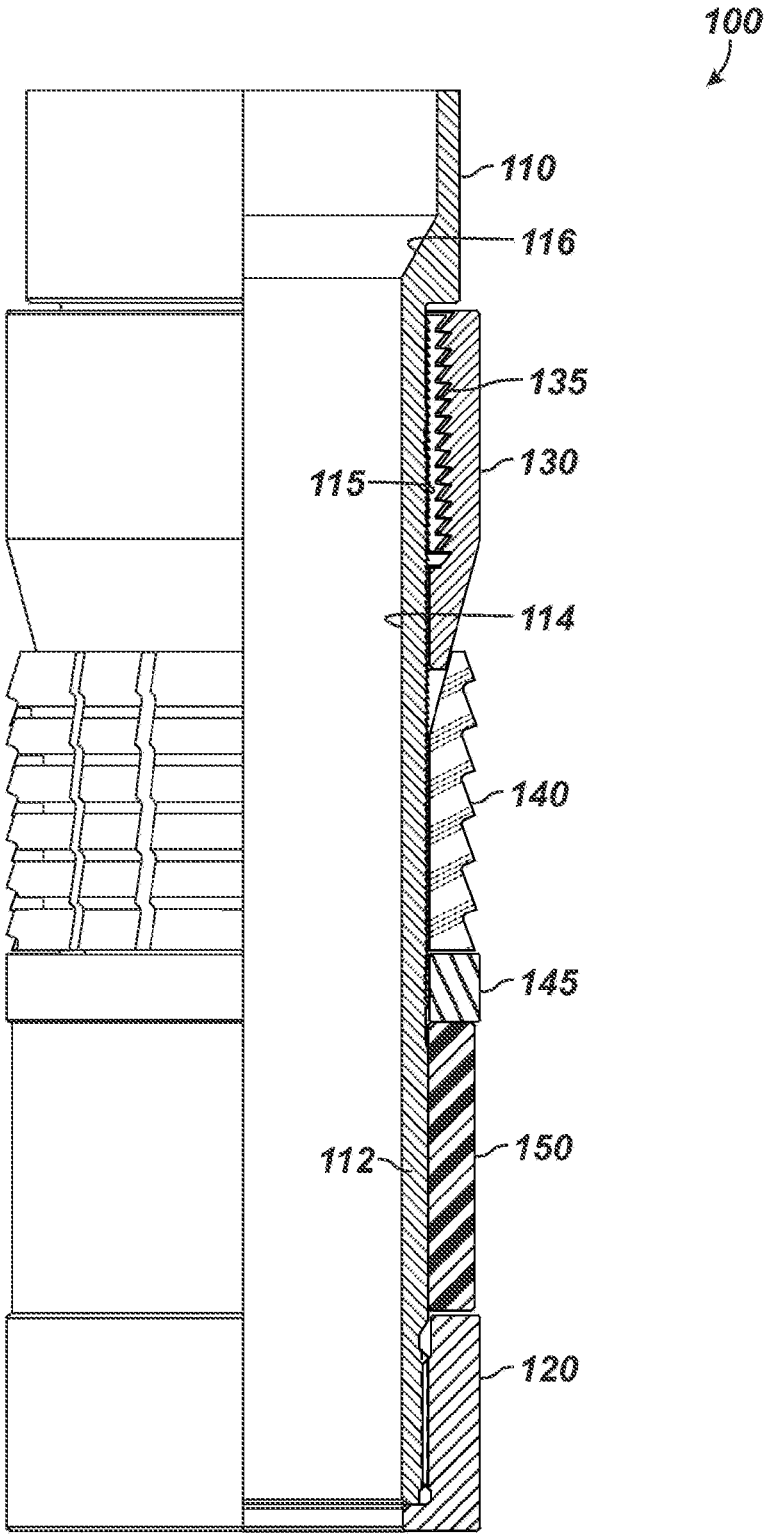
FIG. 3 illustrates a downhole tool having a slip configuration according to the present disclosure in partial cross-section.

FIG. 3 illustrates a downhole tool 100 having a slip configuration according to the present disclosure. The downhole tool 100 can be a packer, a plug, or the like used to isolate portions of a wellbore. A mandrel 110 of the downhole tool 100 has a lower sub or shoulder element 120 affixed at one end. The opposite end has a cone 130 disposed on the mandrel 110. Between the lower shoulder element 120 and the cone 130, a slip 140 abuts between the cone 130 and an upper shoulder element 145, and a sealing element 150 abuts between the upper and lower shoulder elements 145, 120. As shown, the slip 140 has one end portion disposed toward the sealing element and has another end portion disposed toward the cone. This other end portion can be defined as an inclined surface for positioning against an inclined surface of the cone.

As also shown, the upper shoulder element 145 can be used because the end of the slip 140 may not suitably compress the sealing element 150 due to reduced width and/or thickness of the slip 140. For this reason, the upper shoulder element 145 in the form of a spacer, ring, or the like is preferably used to make the transfer of force consistent. Other configurations may not require the shoulder element 145, instead using part of the slip 140 to compress the sealing element 150.

The slip 140 can include any of the various types of slips used. For example, the slip 140 can include a plurality of slip segments disposed circumferentially around the mandrel 110 or can include a ring body. Moreover, the slips can be composed of cast iron or can be composite slips with inserts, etc.

Overall, the tool 100 can be composed of suitable materials for the application. For example, the tool 100 as a fracture plug may be composed primarily of composite materials so that components like the mandrel 110, cone 130, slip 140, and shoulder elements 145, 120 can be composed of composite, plastic, or the like. One or more of the components of the tool 100 can be composed of metal. In general, the sealing element 150 is composed of an elastomeric sleeve for being compressed to create a seal with a surrounding surface of tubing, casing, or the like.

Figure 4A:
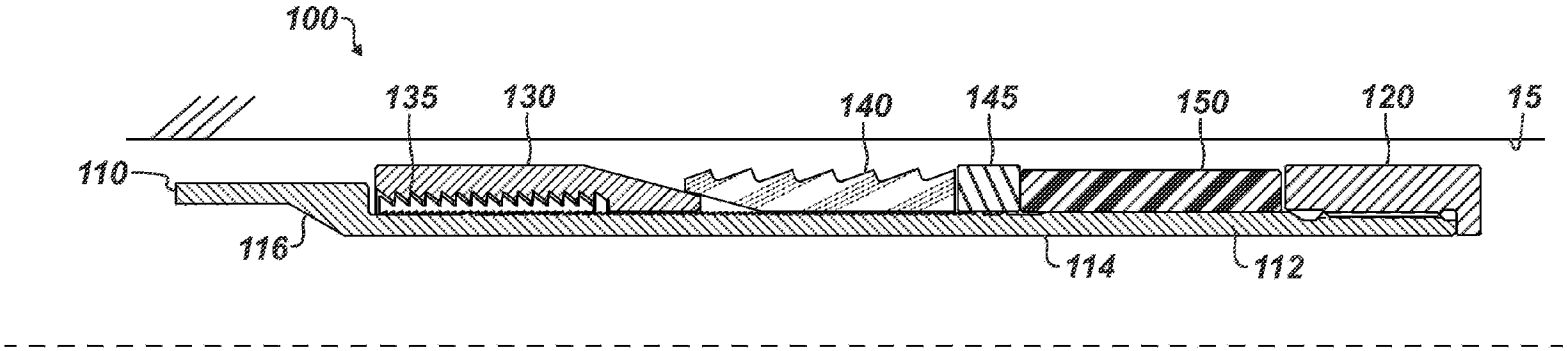
Figure 4B:
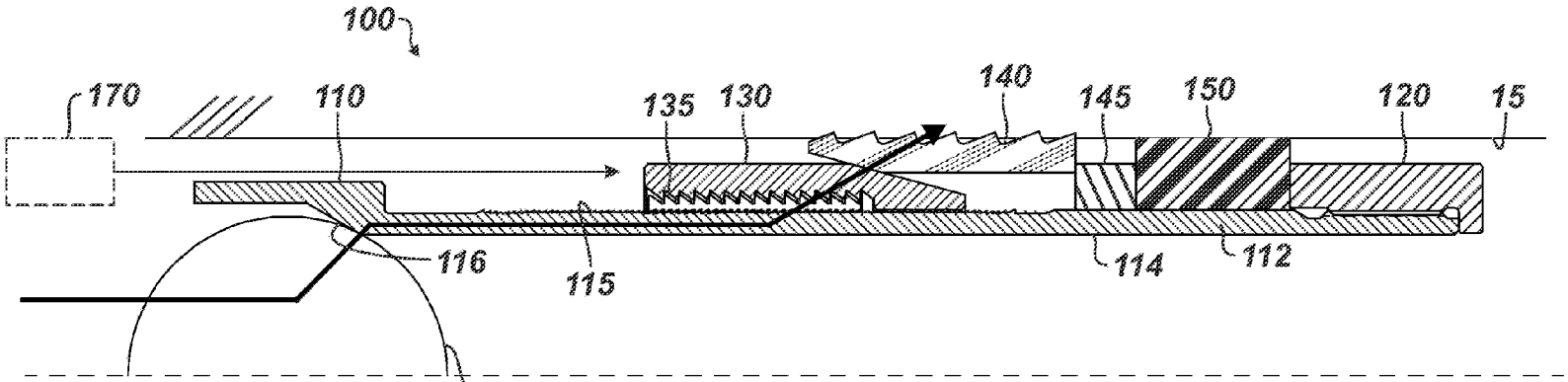
FIG. 4B illustrate the slip configuration on the downhole tool after the sealing element has been set, the mandrel has been plugged, and pressure has been applied.

During run-in of the tool 100 through the tubing 15 (e.g., casing or the like) as shown in FIG. 4A, the shoulder elements 145, 120 are spaced apart, the slip 140 lays retracted against the mandrel 110, and the sealing element 150 is uncompressed. When the tool 100 reaches a desired depth in the tubing 15, the tool 100 can be set as shown in FIG. 4B. To set the tool 100, the shoulder elements 145, 120 are moved toward one another, either by holding the cone 130 and pulling up on the mandrel 110, by holding the mandrel 110 and pushing against the cone 130, or by performing a combination of these actions.

When deployed downhole, for example, the tool 100 can be activated by a setting mechanism 170. In general, the setting mechanism 170 can be a separate tool from the downhole tool 100 or can be a device that is part of the tool 100. For example, the setting mechanism 170 can be a wireline setting tool that uses conventional techniques of pulling against the mandrel 110 while simultaneously pushing upper components. The tool 100 can be set in other ways, such as being set hydraulically with a hydraulic setting mechanism, sleeve, pistons, etc. disposed on the mandrel 110.

In either embodiment, the cone 130 moves along the mandrel 110 toward the lower shoulder element 120 and wedges against the slip 140, which begins to set against the tubing 15. Meanwhile, the slip 140 pushes the upper shoulder element 145 toward the lower element 120 and compresses the sealing element 150 there between. Finally, the sealing element 150 expands outward against the tubing 15 to create a seal in the annulus between the mandrel 110 and the tubing 15. The force used to set the tool 100 as a fracture plug may be as low as 15,000 lbf and could even be as high as 85,000 lbf. These values are only meant to be examples and could vary for the size of the tool 100 or other variables.

Eventually during operations, operators may close off the through-bore 114 of the tool's mandrel 110 so that pressure can be applied uphole of the tool 100 but prevented from communicating past the set tool 100. As shown in FIG. 4B, a ball, a dart, a plug, a valve, a seal, or other plugging element B can close off fluid communication through the through-bore 114. As specifically shown here, the plugging element B is a ball deployed to the tool 100 to engage a seat 116 in the mandrel's through-bore 114. With the ball B seated, the set tool 100 isolates upper and lower portions of the tubing 15 so that fracture and other operations can be completed uphole of the tool 100, while pressure is kept from downhole locations. When used during fracture operations, for example, the tool 100 may isolate pressures of 10,000 psi or so, but may be at any pressure.

Pressure (force) applied against the seated ball B tends to push against the mandrel 110. The pressure (force) applied against the seated ball B passes to the mandrel 110 through the seat 116 and then passes through the anchored cone 130 and slip 140. Eventually, the pressure (force) extends to the tubing 15 from the slip 140.

In general, the wedged slip 140 above the sealing element 150 tends to prevent downhole movement of the tool 100 while in use. Accordingly, the slip 140 can have teeth or other features in a downhole direction to bite into the tubing. To prevent the anchored components from sliding back on the mandrel 110, the cone 130 and mandrel 110 may include a body lock ring 135 or other ratchet mechanism to prevent relative movement of the cone 130 back along a surface 115 of the mandrel 110.

As can be seen, the applied pressure (force) does not act through the sealing element 150, which avoids the problems associated with boost from a seal element collapsing a mandrel. In this way, the configuration allows one, uni-directional slip 140 to be used in a uni-directional pressure application while maintaining a wide inner dimension of the mandrel's through-bore 114 (i.e., a thinner cross-sectional thickness to the wall 112 on the mandrel 110).

During production, the sealing provided by the seated ball B may be removed or dissolved. For example, the tool 100 can be used with a dissolvable fracture ball B or other plug that eventually dissolves and opens fluid communication through the mandrel 100. This embodiment may be used in applications where milling is to be minimized or not performed. Alternatively, the tool 100 may be milled out.

As discussed in the background, the plugged annulus of the tool 100 increases boost forces which, in traditional tools, may lead to the collapse of a mandrel under a sealing element. The configuration disclosed herein, however, allows the tool 100 to be shorter than conventional tools, while maintaining a large inner dimension of the through-bore 114. The large through-bore 114 equates to thinner wall 112 on the mandrel 110 and less mandrel material. In the end, this can negate the need to mill out the tool 100 in some circumstances. The shortened length and reduced cross-section of the tool 100 also reduces the time to mill the tool 100 should milling be utilized. For example, the disclosed tool 100 can be a fracture plug used in situations where milling is to be minimized.

While the embodiments are described with reference to various implementations and exploitations, it will be understood that these embodiments are illustrative and that the scope of the inventive subject matter is not limited to them. Many variations, modifications, additions and improvements are possible.

For example, although not shown in the Figures, the setting mechanism 170 of the tool 100 may use any of the conventional mechanisms, such as hydraulic pistons, sliding sleeves, external setting tools, etc. Additionally, various internal seals, threads, and other conventional features for components of the tool 100 are not shown in the Figures for simplicity, but would be evident to one skilled in the art.

In the present disclosure, reference to the tool can refer to a number of downhole tools, such as a plug, a packer, a liner hanger, an anchoring device, or other downhole tool. For example, a plug as discussed herein can include a bridge plug, a fracture plug, or a two ball fracture plug. A bridge plug has an integral sealing device completely isolating upper and lower annuluses from either direction when set in casing. A fracture plug typically has one ball that is integral or is deployed (dropped or pumped down) to the plug to provide a one-way seal from above. Finally, a two ball fracture plug can also be deployed with a lower integral ball that acts to seal pressure from below, but provides bypass from above. A second ball can be deployed to the plug to seal off pressure above the plug from the lower annulus.

Moreover, although the mandrel 110 is disclosed as having a seat for engaging a ball or other plugging element, the tool 100 may or may not include such as a seat and may not be used for plugging. As a further example, the tool 100 can be a form of plug in which the deployment of a first device (e.g., a ball) sets the slip 140. This first deployed device may be able to set the slips 140 on a plurality of such tools 100 during the same deployment. At a later time, a second device (e.g., a ball) can be deployed to the tool 100. The second device can provide zonal isolation in the tool 100 or can activate an integral valve (e.g., a flapper valve) in the tool 100 to provide the zonal isolation.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole plug for sealing in tubing and useable with a plugging element to support fluid pressure uphole of the downhole plug, the plug comprising:

a mandrel defining a through-bore from an uphole end to a downhole end;

a first shoulder disposed toward the downhole end of the mandrel;

a sealing element for sealing in the tubing, the sealing element disposed on the mandrel adjacent the first shoulder toward the uphole end and compressible on the mandrel toward the downhole end;

a slip disposed on the mandrel adjacent the sealing element toward the uphole end and movable relative to the mandrel toward the downhole end, the slip having a first inclined surface toward the uphole end; and a cone disposed on the mandrel adjacent the slip toward the uphole end and movable relative to the mandrel toward the downhole end, the cone having a second inclined surface adjacent the first inclined surface of the slip;

a ratchet mechanism engaged between the cone and the mandrel, the ratchet mechanism permitting movement of the cone relative to the mandrel toward the downhole end and preventing movement of the cone relative to the mandrel toward the uphole end, wherein in a set condition, the cone and the first shoulder are moved toward one another, the first and second inclined surfaces wedge the slip against the tubing, and the slip moving on the mandrel compresses the sealing element between the slip and the first shoulder; and a seat disposed on the mandrel toward the uphole end and engaging the plugging element deployed in the tubing from the uphole end, the mandrel with the deployed plugging element engaged in the seat supporting a load of the fluid pressure uphole of the tool, the first and second inclined surfaces transferring the load from the mandrel to the slip wedged against the tubing without transferring the load through the sealing element.

2. The plug of claim 1, wherein the through-bore comprises the seat engageable by the plugging element at least partially closing off fluid communication through the through-bore.

3. The plug of claim 1, comprising a second shoulder disposed on the mandrel between the slip and the sealing element, the slip moving the second shoulder toward the first shoulder when compressing the sealing element.

4. The plug of claim 1, wherein the slip comprises first and second portions, the first portion disposed toward the sealing element, the second portion defining the first inclined surface and disposed toward the cone.

5. The plug of claim 4, wherein the cone comprises third and fourth portions, the third portion defining the second inclined surface disposed toward the first inclined surface of the slip.

6. The plug of claim 1, further comprising a setting tool operable to move at least one of the cone and the first shoulder relative the other.

7. The tool of claim 1, wherein the setting tool is separate from the mandrel, or is part of the downhole plug.

8. A method of sealing a downhole tool in tubing, the method comprising:

deploying a mandrel of the downhole tool in the tubing;

moving at least one of a cone and a first shoulder on the mandrel relative the other by ratcheting the cone along the mandrel and preventing movement of the cone in an opposite direction;

wedging a slip disposed on the mandrel adjacent the cone against the tubing moving a second inclined surface of the cone against a first inclined surface of the slip;

compressing a sealing element disposed on the mandrel between the slip and the first shoulder against the tubing;

supporting fluid pressure uphole of the downhole tool by seating a plug on a seat of the mandrel; and supporting a load of the fluid pressure by transferring the load from the mandrel to the second inclined surface of the cone, and transferring the load from the second inclined surface of the cone to the first inclined surface of the slip wedged against the tubing without transferring the load through the sealing element.

9. The method of claim 8, wherein moving the at least one the cone and the first shoulder on the mandrel relative to the other comprises pulling on the mandrel while pushing against the cone.

10. The method of claim 8, wherein supporting fluid pressure uphole of the downhole tool by seating the plug on the seat of the mandrel comprises seating the plug in the seat disposed in a through-bore of the mandrel; and applying the fluid pressure against the seated plug.

* * * * *